US010615496B1

(12) United States Patent
Zeppettella

(10) Patent No.: US 10,615,496 B1
(45) Date of Patent: Apr. 7, 2020

(54) NESTED SPLIT CRESCENT DIPOLE ANTENNA

(71) Applicant: Government of the United States, as represented by the Secretary of the Air Force, Wright-Patterson AFB, OH (US)

(72) Inventor: David L. Zeppettella, Centerville, OH (US)

( * ) Notice: Subject to any disclaimer, the term of this patent is extended or adjusted under 35 U.S.C. 154(b) by 80 days.

(21) Appl. No.: 15/915,706

(22) Filed: Mar. 8, 2018

(51) Int. Cl.

| | |
|---|---|
| ***H01Q 9/28*** | (2006.01) |
| ***H01Q 9/16*** | (2006.01) |
| ***H01Q 3/01*** | (2006.01) |
| *H01Q 1/28* | (2006.01) |

(52) U.S. Cl.
CPC ..... *H01Q 3/01* (2013.01); *H01Q 9/16* (2013.01); *H01Q 9/28* (2013.01); *H01Q 1/28* (2013.01)

(58) Field of Classification Search
CPC ..... H01Q 3/01; H01Q 9/065; H01Q 9/16; H01Q 9/28; H01Q 9/285
See application file for complete search history.

(56) References Cited

U.S. PATENT DOCUMENTS

| | | | | |
|---|---|---|---|---|
| 3,573,834 | A * | 4/1971 | McCabe | H01Q 13/18 343/769 |
| 5,173,715 | A | 10/1992 | Rodal et al. | |
| 5,418,544 | A | 5/1995 | Elliot | |
| 5,745,079 | A | 4/1998 | Wang et al. | |
| 5,874,919 | A | 2/1999 | Rawnick et al. | |
| 6,342,867 | B1 | 1/2002 | Bell | |
| 6,384,790 | B2 | 5/2002 | Dishart et al. | |
| 6,529,170 | B1 | 3/2003 | Nishizawa et al. | |
| 6,828,947 | B2 | 12/2004 | Apostolos et al. | |
| 6,853,342 | B2 | 2/2005 | Podger | |
| 6,879,291 | B2 | 4/2005 | Duxbury et al. | |

(Continued)

FOREIGN PATENT DOCUMENTS

| | | |
|---|---|---|
| EP | 1071161 B1 | 10/2003 |
| WO | 2017100126 A1 | 6/2017 |

OTHER PUBLICATIONS

Azenui, N. et al., "A Printed Crescent Patch Antenna for Ultrawideband Applications," IEEE Antennas and Wireless Propagation Letters, vol. 6, 2007, pp. 113-116.

(Continued)

*Primary Examiner* — Hoang V Nguyen
(74) *Attorney, Agent, or Firm* — AFMCLO/JAZ; Matthew Fair

(57) ABSTRACT

An antenna including a crescent-shaped antenna body having a plurality of crescent-shaped arms with crescent-shaped notched ends; and a connector positioned on a substantially non-jagged portion of the crescent-shaped antenna body to receive input energy, wherein the antenna body operates in a continuous frequency band of operation. The antenna body may transmit an omni-directional output beam. The antenna body may be structurally conformable. The antenna body may be configured to attach to flexible surfaces. The antenna body may be configured to attach to non-planar surfaces. The continuous frequency band of operation may include approximately 165 MHz to 1.35 GHz. The antenna body may be configured to have an average voltage standing wave ratio of approximately 1.72:1 across the continuous frequency band of operation.

9 Claims, 11 Drawing Sheets

(56) References Cited

U.S. PATENT DOCUMENTS

| | | | | |
|---|---|---|---|---|
| 7,015,868 | B2 | 3/2006 | Puente Baliarde et al. | |
| 7,148,850 | B2 | 12/2006 | Puente Baliarda et al. | |
| 7,170,461 | B2 | 1/2007 | Parsche | |
| 7,193,575 | B2 | 3/2007 | Mohammadian | |
| 7,583,236 | B1 | 9/2009 | Lopez | |
| 7,598,867 | B2 | 10/2009 | Carrender | |
| 7,839,347 | B2 * | 11/2010 | Schneider | H01Q 19/10 343/741 |
| 8,855,730 | B2 | 10/2014 | Sanford | |
| 8,994,600 | B2 * | 3/2015 | Schneider | H01Q 19/10 343/741 |
| 9,000,991 | B2 | 4/2015 | Ramberg et al. | |
| 2003/0098814 | A1 | 5/2003 | Keller et al. | |
| 2005/0162332 | A1 * | 7/2005 | Schantz | H01Q 13/10 343/795 |
| 2012/0062433 | A1 | 3/2012 | Balanis et al. | |
| 2012/0068898 | A1 | 3/2012 | Clow et al. | |
| 2012/0092220 | A1 | 4/2012 | Tani et al. | |

OTHER PUBLICATIONS

Liang, Q., "Nested Array for Antenna Deployment in Massive MIMO with Spectrum Efficiency," 2016 IEEE International Conference on Mobile Services, San Francisco, CA, Jun. 27-Jul. 2, 2016, pp. 196-199.

DeNoia, V., et al., "Input impedance behavior of a planar elliptical ring dipole antenna," Antennas and Propagation Society International Symposium (APSURSI), 2012 IEEE, Chicago, IL, Jul. 8-14, 2012, 2 pages.

Irani, K, et al., "Semi-Elliptical Dipole Antenna for RF Energy Scavenging," Antennas and Propagation (ISAP), 2015 International Symposium, Hobart, TAS, Australia, Nov. 9-12, 2015, 4 pages.

Nazli, H., et al., "An Improved Design of Planar Elliptical Dipole Antenna for UWB Applications," IEEE Antennas and Wireless Propagation Letters, vol. 9, Mar. 29, 2010, pp. 264-267.

Obsiye, A., et al., "Modified Printed Crescent Patch Antenna for Ultrawideband RFID (UWB-RFID) Tag," 2008 IEEE International RF and Microwave Conference Proceedings, Kuala Lumpur, Malaysia, Dec. 2-4, 2008, 3 pages.

Sallam, M., et al., "2.4/5 GHz WLAN crescent antenna on flexible substrate," 2016 10th European Conference on Antennas and Propagation (EuCAP), Davos, Switzerland, Apr. 10-15, 2016, 3 pages.

Schantz, H., "Planar Elliptical Element Ultra-Wideband Dipole Antennas," Antennas and Propagation Society International Symposium, IEEE, San Antonio, TX, Jun. 16-21, 2002, pp. 44-47.

Yu, J., et al., "Study of an Ultra Wideband Planar Elliptical Dipole Antenna," International Conference on Microwave Technology and Computational Electromagnetics, ICMTCE, Beijing, China, Nov. 3-6, 2009, pp. 49-52.

* cited by examiner

Elevation
Radiation Beam Pattern

Azimuth
Radiation Beam Pattern

3D Radiation Beam Pattern
(165 MHz)

3D Radiation Beam Pattern
(300 MHz)

3D Radiation Beam Pattern
(800 MHz)

3D Radiation Beam Pattern
(1.3 GHz)

NESTED SPLIT CRESCENT DIPOLE ANTENNA

GOVERNMENT INTEREST

The invention described herein may be manufactured and used by or for the Government of the United States for all government purposes without the payment of any royalty.

BACKGROUND

Field of the Invention

The embodiments herein generally relate to antennas, and more particularly to dipole antennas.

Background of the Invention

Antennas can generally be categorized as directional antennas and omni-directional antennas. Directional antennas typically focus a beam in one direction while an omni-directional antenna radiates power uniformly over 360° in a single plane. The choice of the type of antenna to use is typically based on the application, signal requirements, and location. The use of conformal and load-bearing antennas in polymer composite structures has been proposed as a means of addressing the space and weight constraints associated with autonomous and remotely piloted aircraft. Moreover, at a very high frequency (VHF) and a lower ultra high frequency (UHF), the size of the antenna becomes large and conformal application on curved surfaces, such as aircraft, becomes difficult. As such, although the use of self-complimentary geometry (such as a pair of ellipses or disks) is well-known to provide ultra wideband (UWB) antenna performance, the required antenna size at VHF frequencies combined with the solid nature of the geometric shape presents difficulty in either allowing a flexible surface to change shape or attaching the geometry to a complex shape.

BRIEF SUMMARY OF THE INVENTION

In view of the foregoing, an embodiment herein provides an antenna comprising a crescent-shaped antenna body comprising a plurality of crescent-shaped arms having crescent-shaped notched ends; and a connector positioned on a substantially non-jagged portion of the crescent-shaped antenna body to receive input energy, wherein the antenna body operates in a continuous frequency band of operation. The antenna body may transmit an omni-directional output beam. The antenna body may be structurally conformable. The antenna body may be configured to attach to flexible surfaces. The antenna body may be configured to attach to non-planar surfaces. The continuous frequency band of operation may comprise approximately 165 MHz to 1.35 GHz. The antenna body may be configured to have an average voltage standing wave ratio of approximately 1.72:1 across the continuous frequency band of operation. The antenna body may be comprised of a foam substrate and is configured to have an average voltage standing wave ratio of approximately 1.85:1 across the continuous frequency band of operation. The antenna body may comprise a dipole configuration.

Another embodiment provides a dipole antenna comprise a substrate; and a pair of antenna arms, wherein each pair of antenna arms comprises a first crescent-shaped arm configured on the substrate and comprising a convex outer edge and a first set of tapered notched ends; and a second crescent-shaped arm configured on the substrate, contacting the first crescent-shaped arm, and comprising a second set of tapered notched ends, wherein the second crescent-shaped arm is smaller in size than the first crescent-shaped arm, and wherein each of the first crescent-shaped arms of the pair of antenna arms contact each other on the convex outer edge. A separation distance between each of the first and second crescent-shaped arms may be a function of a dielectric constant of the substrate. A separation distance between each of the first and second crescent-shaped arms may be approximately 2 mm. The pair of antenna arms may form a symmetrical arrangement.

Another embodiment provides a method of forming a dipole antenna, the method comprising providing a substrate; providing a conductive sheet; shaping the conductive sheet into a plurality of crescent-shaped regions in a dipole arrangement; creating gaps between portions of each successive crescent-shaped region; attaching the shaped conductive sheet to the substrate to form the dipole antenna; and configuring the dipole antenna to operate in a continuous frequency band of operation. The method may comprise shaping the conductive sheet using a photoetching process. The method may comprise machining the conductive sheet from a predetermined material. The predetermined material may comprise flexible graphite. The predetermined material may comprise expanded metal. The method may comprise positioning an input power feed point on the dipole antenna; and attaching a radio frequency connector at the input power feed point of the dipole antenna. The method may comprise configuring a thickness and material composition of the dipole antenna such that that dipole antenna is structurally conformable.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE INVENTION

Figure 1:
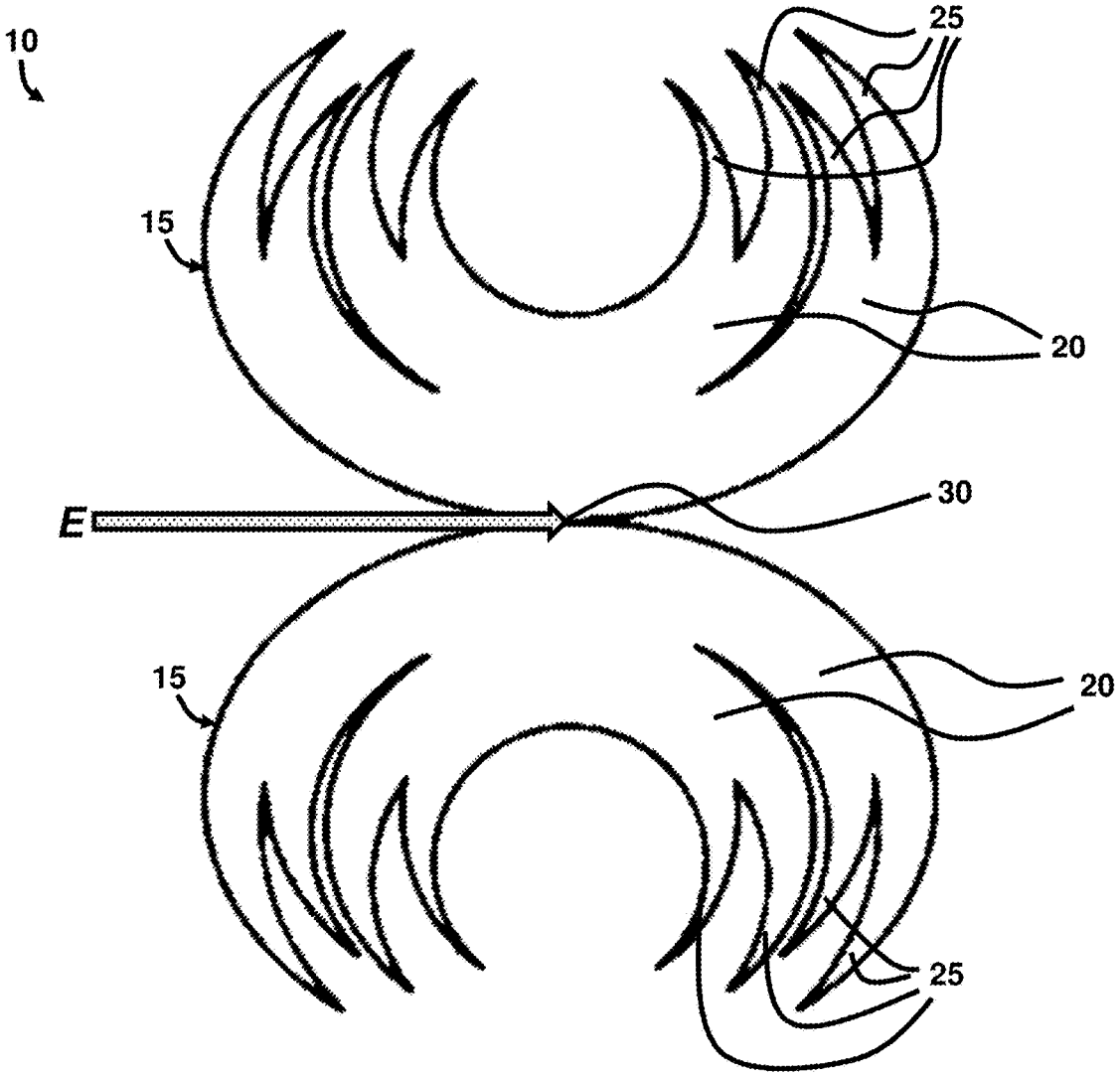
FIG. 1 is a schematic diagram illustrating an antenna, according to an embodiment herein.

Embodiments of the disclosed invention, its various features and the advantageous details thereof, are explained more fully with reference to the non-limiting embodiments that are illustrated in the accompanying drawings and detailed in the following description. Descriptions of well-known components and processing techniques are omitted to not unnecessarily obscure what is being disclosed. Examples may be provided and when so provided are intended merely to facilitate an understanding of the ways in which the invention may be practiced and to further enable those of skill in the art to practice its various embodiments. Accordingly, examples should not be construed as limiting the scope of what is disclosed and otherwise claimed.

In the drawings, the size and relative sizes of layers and regions may be exaggerated for clarity. The embodiments herein provide a dipole antenna configured with a series of crescent-shaped arms with gaps/notches in between portions of the arms. The shape of the antenna arms together with the gaps/notches allows the antenna to be attached to complex, non-planar, or curved underlying surfaces such as an aircraft's wings. The complete dipole antenna is formed by placing a second arm, identical to the first arm, in a mirror image position across a line tangent to the inflection point of the convex side on large crescent of the first arm. The crescent-shaped arms are positioned adjacent to one another with the successive arms being smaller than the proceeding arms. A mirror image of the crescent-shaped arms with gaps is provided to create a dipole antenna configuration. The antenna is an ultra-wide band dipole antenna that has an 8:1 bandwidth ratio beginning at approximately 165 MHz up to approximately 1.35 GHz and operates in a continuous frequency band. The antenna has an average voltage standing wave ratio of 1.72:1 across the continuous operating frequency band. The antenna is non-fractal and is an omni-directional antenna. Referring now to the drawings, and more particularly to FIGS. 1 through 11, where similar reference characters denote corresponding features consistently throughout, there are shown exemplary embodiments.

FIG. 1 illustrates an antenna 10 comprising a crescent-shaped antenna body 15 comprising a plurality of crescent-shaped arms 20 having crescent-shaped notched ends 25. The crescent-shaped arms 20 are one continuous structure in one example, or may be discontinuous structures that are electrically connected to each other, in another example. The crescent-shaped notched ends 25 provide both electrical (e.g., current flow) and mechanical (e.g., structural flexing) functions. A connector 30 is positioned on a substantially non-jagged portion of the crescent-shaped antenna body 15 to receive input energy E and to drive the electrical signals of the antenna 10, wherein the antenna body 15 operates in a continuous frequency band of operation, as opposed to a fractal frequency band of operation. The continuous frequency band of operation is provided by inputting the energy E on the smooth portion (i.e., location of the connector 30) of the crescent-shaped antenna body 15. The number of crescent-shaped arms 20 may be selected based on the desired bandwidth of the antenna 10. Generally, the more arms 20, the greater the bandwidth.

In an example, the arms 20 are conductive and may comprise copper or flexible graphite. The antenna body 15 may be structurally conformable or flexing, wherein the crescent-shaped notched ends 25 permit the antenna body 15 to be shape-changing. The connector 30 is configured as an electrical connector that is operable at radio frequencies in the multi-megahertz range. In an example, the connector 30 may be a coaxial radio frequency (RF) connector, wherein a coaxial cable (not shown) may be connected to the connector 30.

Figure 2A:
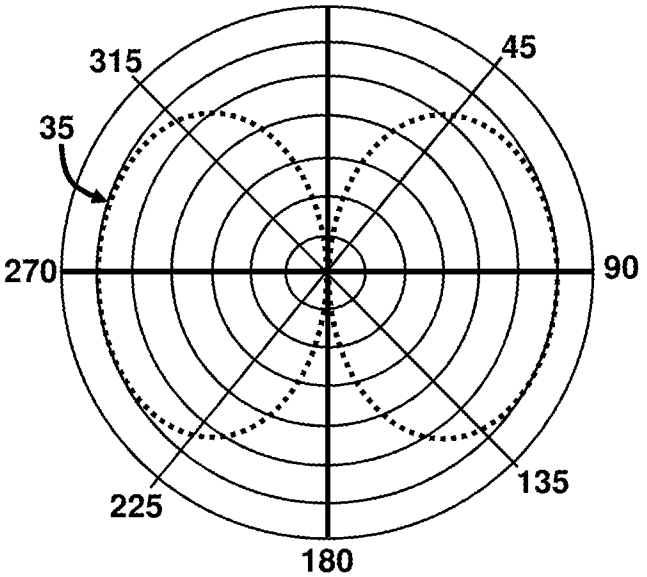
FIG. 2A is a schematic diagram illustrating the elevation radiation beam pattern associated with the antenna of FIG. 1, according to an embodiment herein.
Figure 2B:
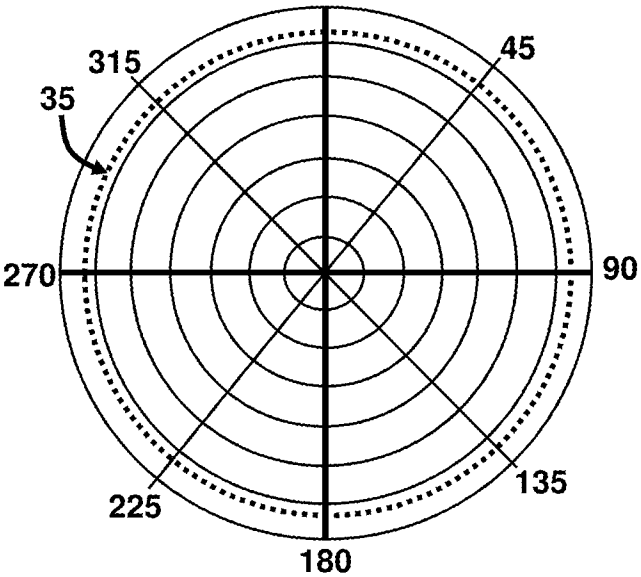
FIG. 2B is a schematic diagram illustrating the azimuth radiation beam patterns associated with the antenna of FIG. 1, according to an embodiment herein.
Figure 2C:
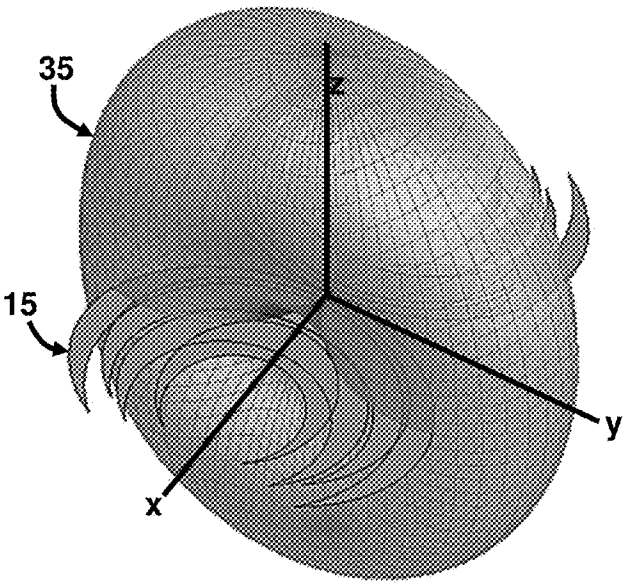
FIG. 2C is a schematic diagram illustrating the three-dimensional radiation beam pattern associated with the antenna of FIG. 1 at 165 MHz, according to an embodiment herein.

As shown in FIGS. 2A through 2C, with reference to FIG. 1, the antenna body 15 may transmit an omni-directional output beam 35. In a two-dimensional view, the omni-directional output beam 35 is shown in a polar format; with the elevation radiation beam pattern shown in FIG. 2A, and the azimuth radiation beam pattern shown in FIG. 2B. Generally, the omni-directional output beam 35 is substantially doughnut-shaped when viewed as a three-dimensional (3D) radiation beam pattern at 165 MHz, as shown in FIG. 2C. The radiation or antenna pattern typically describes the relative strength of the radiated electric field in various directions from the antenna body 15 at a constant distance.

Figure 2D:
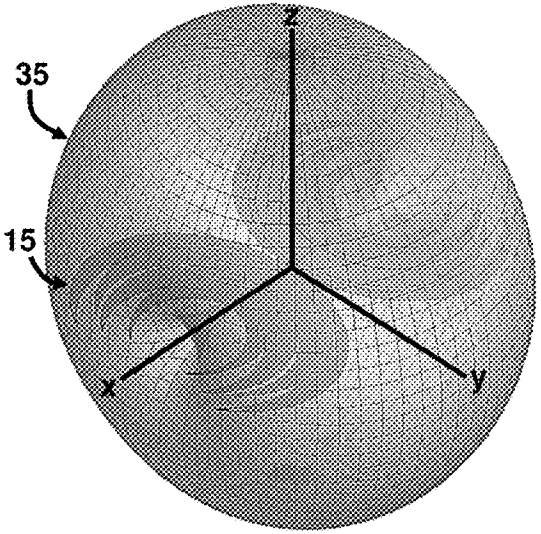
FIG. 2D is a schematic diagram illustrating the three-dimensional radiation beam pattern associated with the antenna of FIG. 1 at 300 MHz, according to an embodiment herein.
Figure 2E:
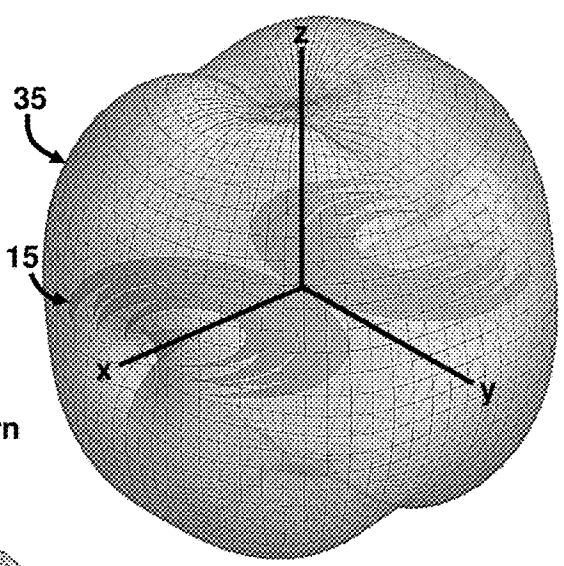
FIG. 2E is a schematic diagram illustrating the three-dimensional radiation beam pattern associated with the antenna of FIG. 1 at 800 MHz, according to an embodiment herein.
Figure 2F:
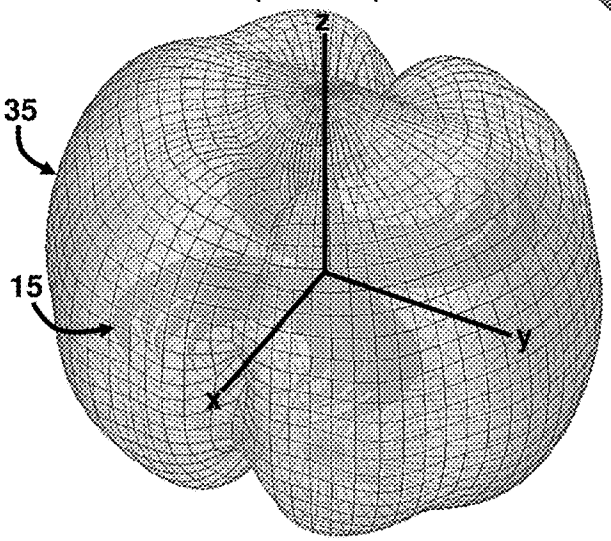
FIG. 2F is a schematic diagram illustrating the three-dimensional radiation beam pattern associated with the antenna of FIG. 1 at 1.3 GHz, according to an embodiment herein.

In an example, the gain of the omni-directional antenna 10 may be increased by narrowing the beamwidth (e.g., the angular aperture where the main/significant power is radiated from the antenna 10) in the vertical or elevation plane, which focuses the energy of the antenna 10 toward the horizon. The radiation beam pattern changes based on the frequency of operation of the antenna 10. FIGS. 2D through 2F, with reference to FIGS. 1 through 2C, depict example 3D radiation beam patterns associated with the omni-directional output beam 35 from the antenna body 15, at 300 MHz, 800 MHz, and 1.3 GHz, respectively. As shown in FIGS. 2D through 2F, the conductive geometry of the radiation beam patterns become significantly larger than a wavelength as frequency increases, which aligns with expected patterns characteristic of wideband antennas, and which further reveals the proper operability of the antenna 10. The operational band is determined by the physical size of the geometry of the antenna 10. For example, if the dimensions of the antenna 10 are scaled by a factor of ⅙, the antenna 10 operates from about 1 GHz to 8 GHz and has a footprint of approximately 8 cm×11 cm.

Figure 3A:
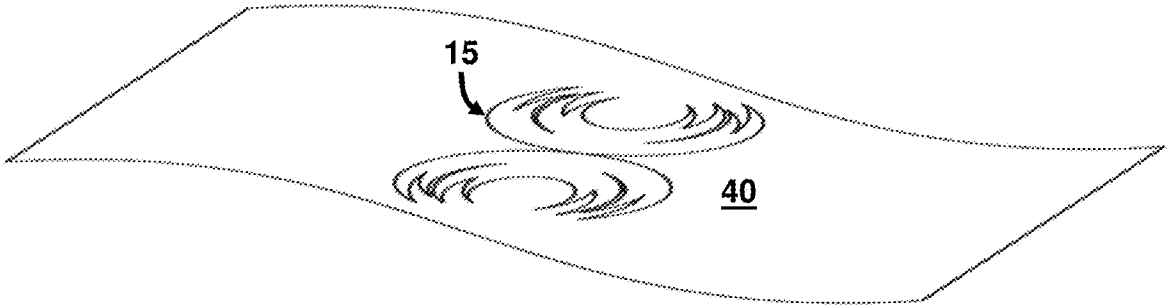
FIG. 3A is a schematic diagram illustrating an antenna body attached to a flexible surface, according to an embodiment herein.
Figure 3B:
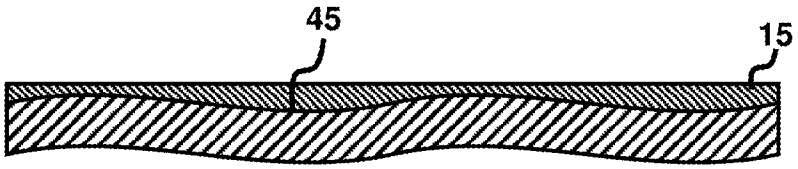
FIG. 3B is a cross-sectional diagram illustrating an antenna body attached to a non-planar surface, according to an embodiment herein.

The antenna body 15 is structurally conformable in that it is able to attach to an underlying surface by adapting the shape/configuration of the antenna body 15 to align with the shape/configuration of the underlying surface. In other words, the antenna body 15 is capable of shape-changing. The configuration of the crescent-shaped arms 20 with the crescent-shaped notched ends 25 permits this conformable, shape-changing functionality. In an example, the antenna body 15 may be configured to attach to flexible surfaces 40 as shown in FIG. 3A, with reference to FIGS. 1 through 2F. In another example, the antenna body 15 may be configured to attach to non-planar surfaces 45 as shown in the cross-sectional diagram of FIG. 3B, with reference to FIGS. 1 through 3A. As indicated in FIG. 3B, the antenna body 15 shape-changes to match the corresponding shape of the underlying non-planar surface 45 without any gaps, voids, or spaces between the antenna body 15 and the non-planar surface 45.

In an example, the continuous frequency band of operation may comprise approximately 165 MHz to 1.35 GHz. The antenna body 15 may be configured to have an average voltage standing wave ratio (VSWR) of approximately 1.72:1 across the continuous frequency band of operation. The VSWR indicates the quality of the impedance match of the antenna 10. A high VSWR is an indication that power that could potentially go into the radiation pattern 35 is reflected back along a feed cable instead of being radiated by the antenna 10. In an example, a VSWR of 2.0:1 or less is considered acceptable in accordance with the embodiments herein.

Figure 4:
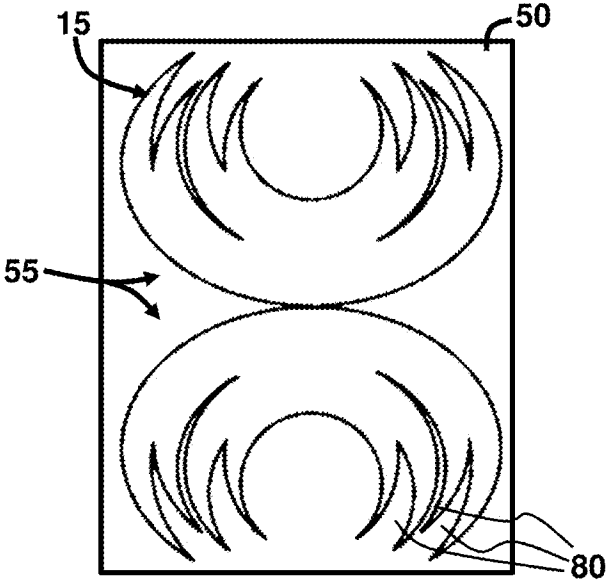
FIG. 4 is a schematic diagram illustrating an antenna in a dipole configuration and attached to a substrate, according to an embodiment herein.

As shown in FIG. 4, with reference to FIGS. 1 through 3B, the antenna body 15 is configured on a substrate 50. The type of substrate 50 will impact VSWR. For example, a FR4 circuit board may be considered, wherein the FR4 circuit board is a flame retardant, fiberglass-reinforced epoxy laminate printed circuit board containing a thin layer of copper foil laminated to one or both sides of a fiberglass epoxy material. A FR4 circuit board with a relative permittivity (i.e., dielectric constant ($\varepsilon_r$))=4.4 and a dielectric loss tangent (tan δ)=0.01 results in average VSWR=1.72:1; while, in an example, the substrate 50 may comprise foam, which approaches the dielectric properties of air, with $\varepsilon_r$~1, and results in an average VSWR=1.85:1. The dielectric loss tangent (tan δ) refers to the dissipation of electromagnetic energy (i.e., heat) of the dielectric material of the substrate 50. As such, the antenna body 15 may be comprised of a foam substrate 50 and is configured to have an average voltage standing wave ratio of approximately 1.85:1 across the continuous frequency band of operation. As further illustrated in FIG. 4, the antenna body 15 may comprise a dipole configuration 55.

In an example, the aggregate shape of the arms 20 can be photo-etched from a copper sheet using any of laser and chemical cutting of the copper sheet to form the desired shaped of the arms 20. Alternatively, the arms 20 could be cut from a copper sheet using computer-aided machine tools. The arms 20 are then attached to a substrate 50 that could be either a flexible material or a dielectric composite structure. The method of attachment is governed by the intended substrate 50. In the case of structural composites, the arms 20 can be included in the lay-up process to form a stack of materials constituting the arms 20, and the resin used to bind the plies together also bonds the antenna 10 to the surface of the underlying component.

The shape of both arms 20 in each dipole shape may be considered as four partially overlapped crescent shapes of different sizes. The process of forming these shapes is the same as for creating a lune in planar geometry. Each of the crescent-shaped arms 20 is derived through the reduction in the area of an ellipse by subtracting the area of a partially overlapping ellipse of the same or slightly smaller size. Each of the three smaller crescent shapes is offset some distance from the convex side of the largest crescent which, when combined with the varying radii of the underlying elliptical geometry, creates notched ends 25 of different sizes that extend down into the antenna arms 20. From a mechanical perspective, these notched ends 25 allow the antenna 10 to conform to complex surfaces and flexible substrates 50. Electrically, the notched ends 25 act in conjunction with each gap 80 between the arms 20 to establish antenna input impedance and also serve to suppress lateral current flow that typically degrades antenna performance. The notched ends 25 may be formed using laser etching patterning techniques followed by a chemical etching process in an appropriate solution.

In an example, the antenna 10 may be used on aircraft such as manned or unmanned aircraft systems. Furthermore, such use may be in either commercial or military aircraft. Moreover, the conformal antenna 10 provided by the embodiments herein may be used for composite aircraft structures to enhance radio communications in the upper VHF and lower UHF bands. More particularly, the antenna 10 may be used on aircraft that are constructed of dielectric structural composites or have structural components constructed of such materials. Some examples of such components include fuselage, vertical stabilizers, and winglets. Alternate applications include installation of the antenna 10 on conformal surfaces of watercraft with dielectric structures or as a portable antenna for remote ground stations where the reduced surface area of the antenna 10 decreases the wind loading on the antenna 10.

Figure 5:
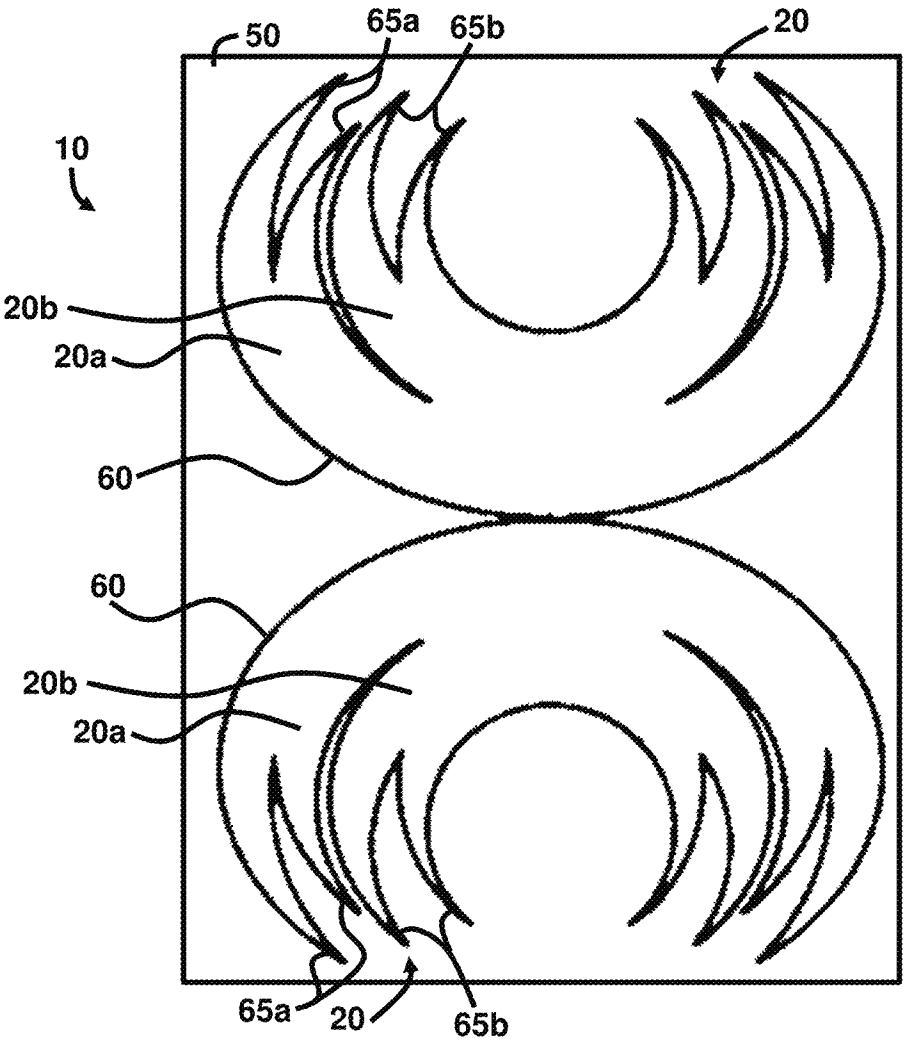
FIG. 5 is a schematic diagram illustrating a dipole antenna with notched ends, according to an embodiment herein.

FIG. 5, with reference to FIGS. 1 through 4, illustrates the dipole antenna 10 comprising a substrate 50. A pair of antenna arms 20 is also provided, wherein each pair of antenna arms 20 comprises a first crescent-shaped arm 20*a* configured on the substrate 50 and comprising a convex outer edge 60 and a first set of tapered notched ends 65*a*; and a second crescent-shaped arm 20*b* configured on the substrate 50, contacting the first crescent-shaped arm 20*a*, and comprising a second set of tapered notched ends 65*b*, wherein the second crescent-shaped arm 20*b* is smaller in size than the first crescent-shaped arm 20*a*, and wherein each of the first crescent-shaped arms 20*a* of the pair of antenna arms 20 contact each other on the convex outer edge 60.

Figure 6:
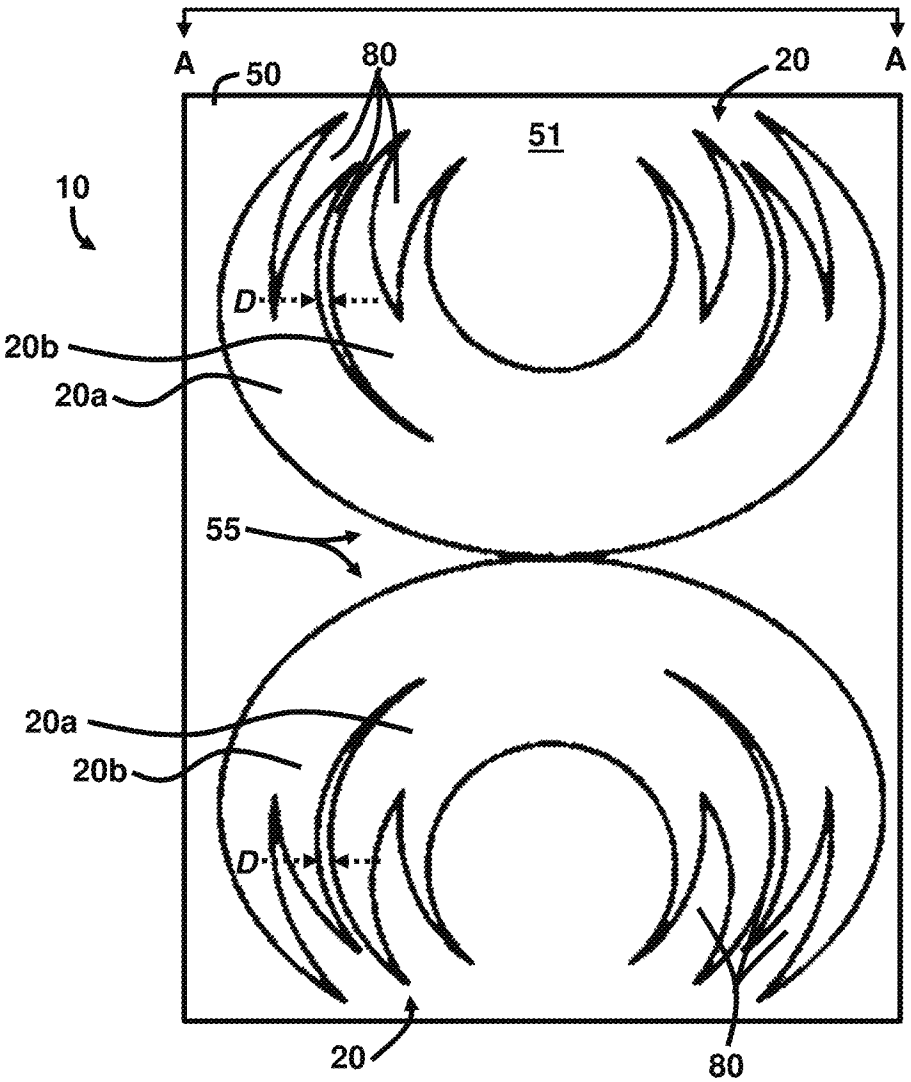
FIG. 6 is a schematic diagram illustrating a dipole antenna with gaps between antenna arms, according to an embodiment herein.

As shown in FIG. 6, with reference to FIGS. 1 through 5, a separation distance D between each of the first and second crescent-shaped arms 20*a*, 20*b* may be a function of a dielectric constant of the substrate 50. The separation distance D between each of the first and second crescent-shaped arms 20*a*, 20*b* may be approximately 2 mm, in an example. The pair of antenna arms 20 (arms 20*a*, 20*b*) may form a symmetrical arrangement, however the embodiments herein are not restricted to a symmetrical arrangement.

The embodiments herein enable an ultra-wideband VHF/UHF antenna 10 to be conformally integrated with a dielectric surface 51 of a substrate 50 that either is flexible or has a fixed, complex curvature. In contrast to the conventional antenna solutions, the antenna 10 provided by the embodiments herein enables shape change (e.g., is structurally conformal) and integration with complex underlying shapes through a reduction of antenna surface area brought about by the introduction of the notched ends 25 and cut-outs (i.e., gaps 80). Specifically, the conformal, UWB VHF/UHF antenna 10 may be used on flexible surfaces 40 (as shown in FIG. 3A) and complex shapes including non-planar surfaces 45 (as shown in FIG. 3B) and achieves a 40% reduction in antenna surface area compared to conventional dipole antennas, and without a loss of impedance bandwidth.

Figure 7E:
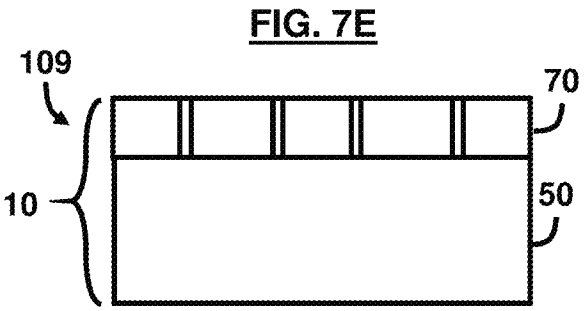
FIG. 7E is a schematic diagram illustrating a fifth step in a process for manufacturing a dipole antenna, according to an embodiment herein.
Figure 7F:
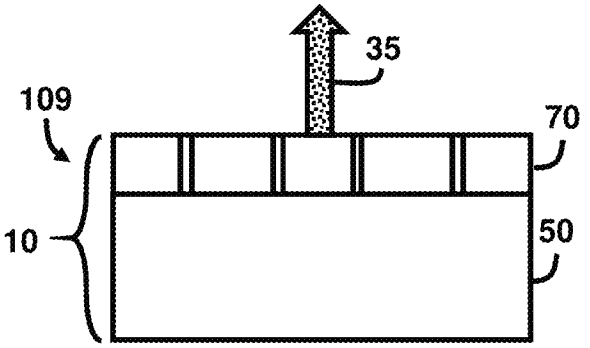
FIG. 7F is a schematic diagram illustrating use of a dipole antenna, according to an embodiment herein.
Figure 7A:
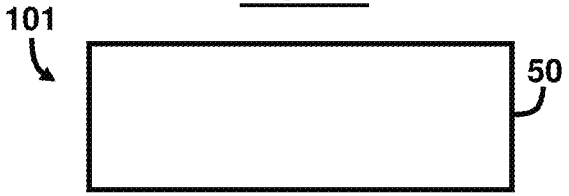
FIG. 7A is a schematic diagram illustrating a first step in a process for manufacturing a dipole antenna, according to an embodiment herein.
Figure 7B:
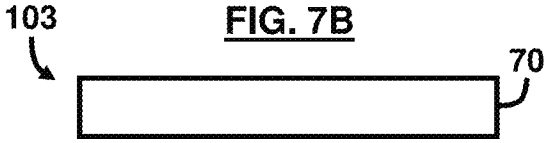
FIG. 7B is a schematic diagram illustrating a second step in a process for manufacturing a dipole antenna, according to an embodiment herein.
Figure 7C:
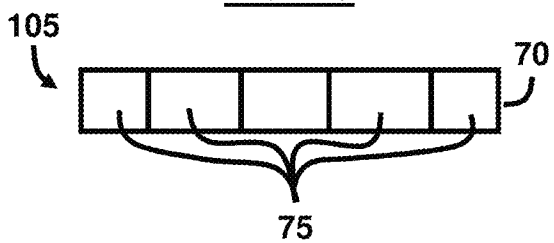
FIG. 7C is a schematic diagram illustrating a third step in a process for manufacturing a dipole antenna, according to an embodiment herein.
Figure 7D:
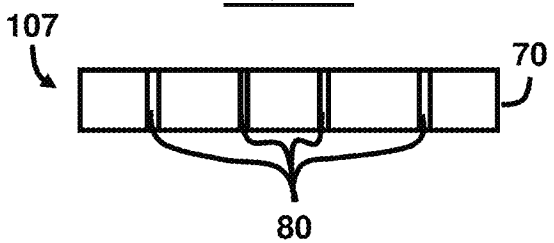
FIG. 7D is a schematic diagram illustrating a fourth step in a process for manufacturing a dipole antenna, according to an embodiment herein.
Figure 8:
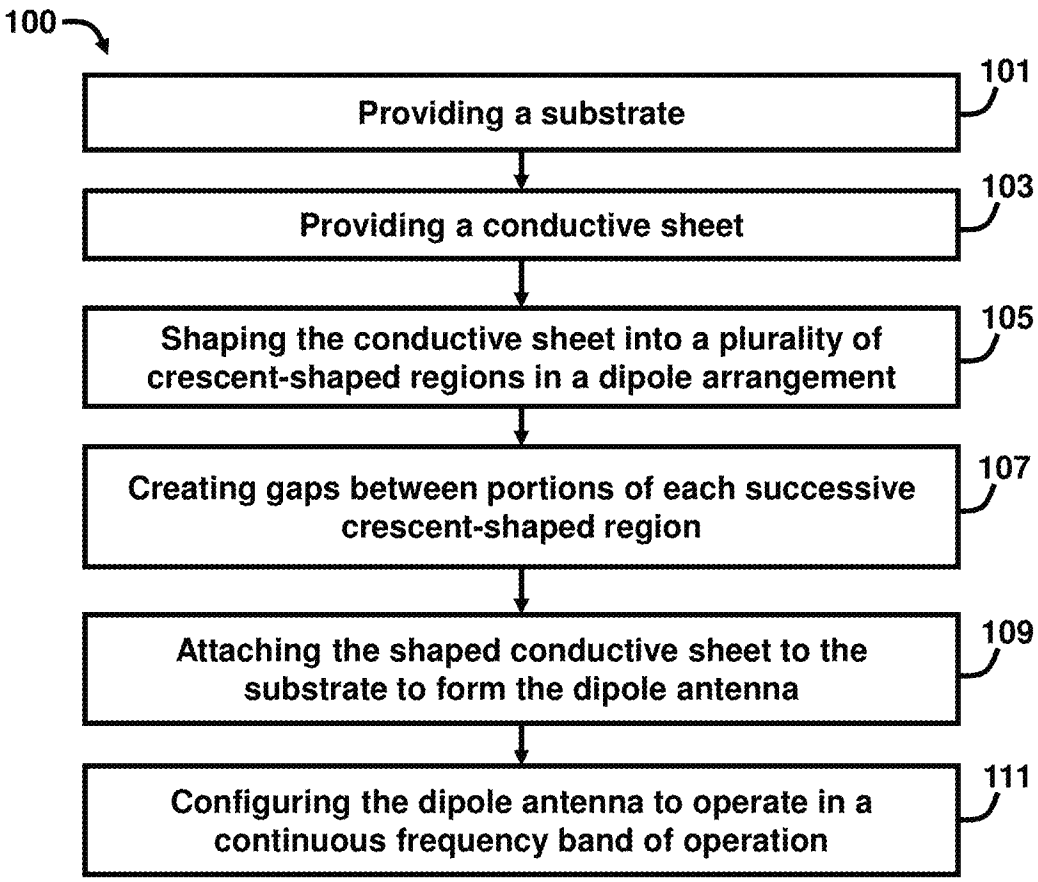
FIG. 8 is a flow diagram illustrating a method of forming a dipole antenna, according to an embodiment herein.

FIGS. 7A through 7E, with reference to FIGS. 1 through 6, are successive manufacturing steps of forming a dipole antenna 10. FIG. 7F, with reference to FIGS. 1 through 7E, illustrates use of the dipole antenna 10, according to an embodiment. The views depicted in FIGS. 7A through 7F are taken along the line A-A in FIG. 6. FIG. 8, with reference to FIGS. 1 through 7F, is a flow diagram illustrating the manufacturing method 100 depicted in in FIGS. 7A through 7F. The method 100 comprises providing (101) a substrate 50, as shown in FIG. 7A; providing (103) a conductive sheet 70, as shown in FIG. 7B; shaping (105) the conductive sheet 70 into a plurality of crescent-shaped regions 75 in a dipole arrangement (e.g., dipole configuration 55), as shown in FIG. 7C; creating (107) gaps 80 between portions of each successive crescent-shaped region 75, as shown in FIG. 7D; attaching (109) the shaped conductive sheet 70 to the substrate 50 to form the dipole antenna 10, as shown in FIG. 7E; and configuring (111) the dipole antenna 10 to operate in a continuous frequency band of operation upon outputting the omni-directional output beam 35, as shown in FIG. 7F. In an example, the conductive sheet 70 may be between approximately 32-40 μm. The method 100 may comprise shaping the conductive sheet 70 using a suitable photoetching process. The method 100 may comprise machining the conductive sheet 70 from a predetermined material. The predetermined material may comprise flexible graphite, in one example. The predetermined material may comprise expanded metal (e.g., sheet metal that has been cut and stretched in a particular mesh-like pattern), in another example.

Figure 9:
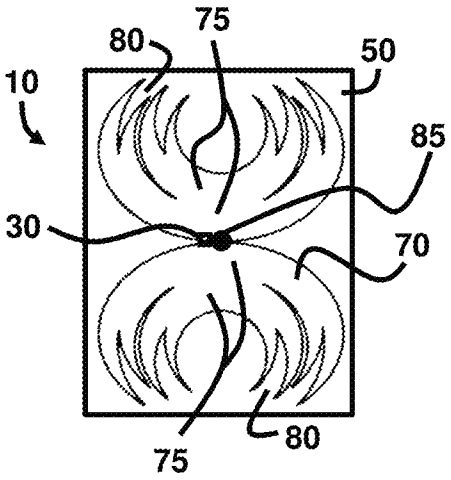
FIG. 9 is a schematic diagram illustrating a dipole antenna with a connector, according to an embodiment herein.

The method 100 may comprise positioning an input power feed point 85 on the dipole antenna 10, as shown in FIG. 9, with reference to FIGS. 1 through 8, and attaching a radio frequency connector 30 at the input power feed point 85 of the dipole antenna 10. The method 100 may comprise configuring a thickness and material composition of the dipole antenna 10 such that that dipole antenna 10 is structurally conformable. For receive-only applications, the connector 30 may be a SubMiniature version A radio frequency (SMA RF) connector, for example, that can be attached at the feed point 85 such that the center conductor is attached to one arm, and the ground is attached to the opposite arm. The connector 30 can be attached through conventional soldering techniques or with conductive epoxy. A balun component such as a RF balun (not shown) may be used for transmitting applications to prevent radiation from the shield of the feed cable (not shown); however, the balun itself may become the limiting factor for impedance bandwidth or transmit power, and as such other techniques such as feeding with a co-planar waveguide geometry may be utilized for implementation of the antenna 10 in transmit applications.

The antenna arms 20 can be manufactured from any type of conductive sheet 70 or fine mesh material, such as aluminum and flexible graphite, for example. The skin effect depth at the low end of the operating band is considered when determining material thickness, with the rule of thumb being to provide five skin depths. The skin depth for aluminum at 165 MHz is approximately 6.4 microns; therefore, aluminum antenna arms may have a thickness no less than approximately 32 microns, according to an example. Additionally, the use of less conductive materials may reduce the radiation efficiency of the antenna 10.

Figure 10:
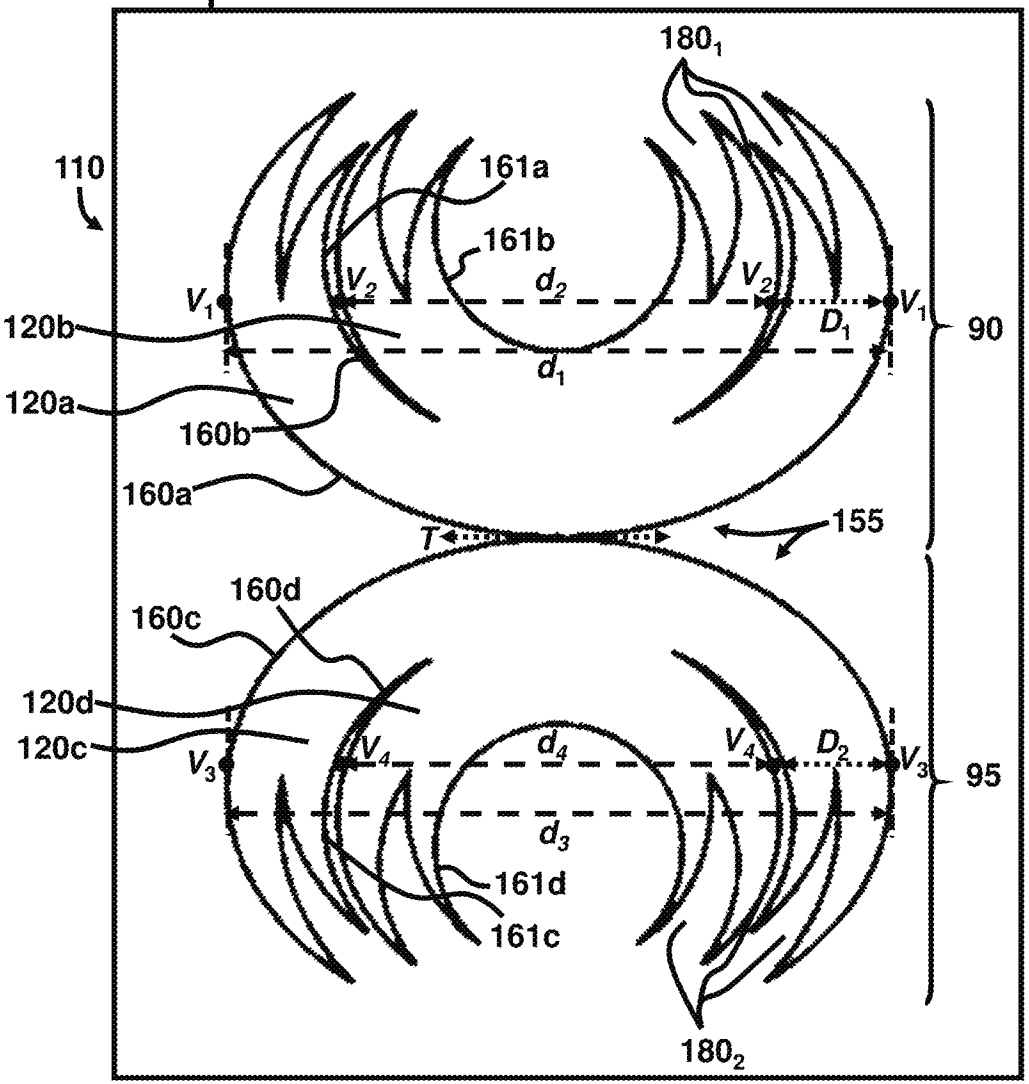
FIG. 10 is a schematic diagram illustrating a dipole antenna depicting vertices of the crescent-shaped arms, according to an embodiment herein.

FIG. 10, with reference to FIGS. 1 through 9, illustrates a dipole antenna 110 comprising a substrate 150. A first set 90 of a plurality of partially elliptical arms 120*a*, 120*b* are adjacent to one another and positioned on the substrate 50, wherein successive arms 120*a*, 120*b* in the first set 90 are arranged in a progressively smaller configuration such that a distance $d_1$, $d_2$ between vertices $V_1$, $V_2$ of each successive arm in the first set 90 is progressively shorter than a preceding arm in the first set 90. A first set of a plurality of curvilinear gaps 1801 separates a portion of each arm from an adjacent arm (e.g., between arms 120*a* and 120*b*, for example).

A second set 95 of a plurality of partially elliptical arms 120*c*, 120*d* is adjacent to one another and positioned on the substrate 150, wherein successive arms 120*c*, 120*d* in the second set 95 are arranged in a progressively smaller configuration such that a distance $d_3$, $d_4$ between vertices $V_3$, $V_4$ of each successive arm in the second set 95 is progressively shorter than a preceding arm in the second set 95. A second set 95 of a plurality of curvilinear gaps 1802 separates a portion of each arm from an adjacent arm (e.g., between arms 120*c* and 120*d*, for example). In an example, there is a symmetrical arrangement of the first set 90 with respect to the second set 95 creating a dipole antenna configuration 155, wherein the dipole configuration 155 operates in a continuous frequency band of operation.

The plurality of partially elliptical arms 120*a*-120*d* are substantially crescent-shaped. Each set 90, 95 of the plurality of partially elliptical arms 120*a*-120*d* comprises a first crescent-shaped arm 120*a* comprising a first inflection point (e.g., vertex $V_1$) and a first convex edge 160*a*; a second crescent-shaped arm 120*b* comprising a second inflection point (e.g., vertex $V_2$) and a second convex edge 160*b*, wherein the second inflection point (e.g., vertex $V_2$) is offset from the first inflection point (e.g., vertex $V_1$) by a first distance $D_1$; a third crescent-shaped arm 120*c* comprising a third inflection point (e.g., vertex $V_3$) and a third convex edge 160*c*; and a fourth crescent-shaped arm 120*d* comprising a fourth inflection point (e.g., vertex $V_4$) and a fourth convex edge 160*d*, wherein the fourth inflection point (e.g., vertex $V_4$) is offset from the third inflection point (e.g., vertex $V_3$) by a second distance $D_2$ equal to the first distance $D_1$. The plurality of partially elliptical arms 120*a*, 120*b* further include, respectively, a first concave edge 161*a* and a second concave edge 161*b* oriented in the same direction. Likewise, the plurality of partially elliptical arms 120*c*, 120*d* further include, respectively, a third concave edge 161*c* and the fourth concave edge 161*d* oriented in the same direction.

The symmetrical arrangement created by the dipole antenna configuration 155 of the first set 90 with respect to the second set 95 is defined by a line of tangent T, which is parallel to the lines defined by distances $d_1 \ldots d_4$ between the respective inflection points (e.g., vertices $V_1 \ldots V_4$). Each of the first set 90 of partially elliptical arms 120*a*, 120*b* and the second set 95 of partially elliptical arms 120*c*, 120*d* comprises a conductive material having a thickness of five skin depths at 165 MHz. The substrate 150 comprises any of a flexible material and a dielectric material. The plurality of curvilinear gaps 1801 in the first set 90 are of different sizes with respect to one another, and wherein the plurality of curvilinear gaps 1802 in the second set 95 are of different sizes with respect to one another.

Figure 11:
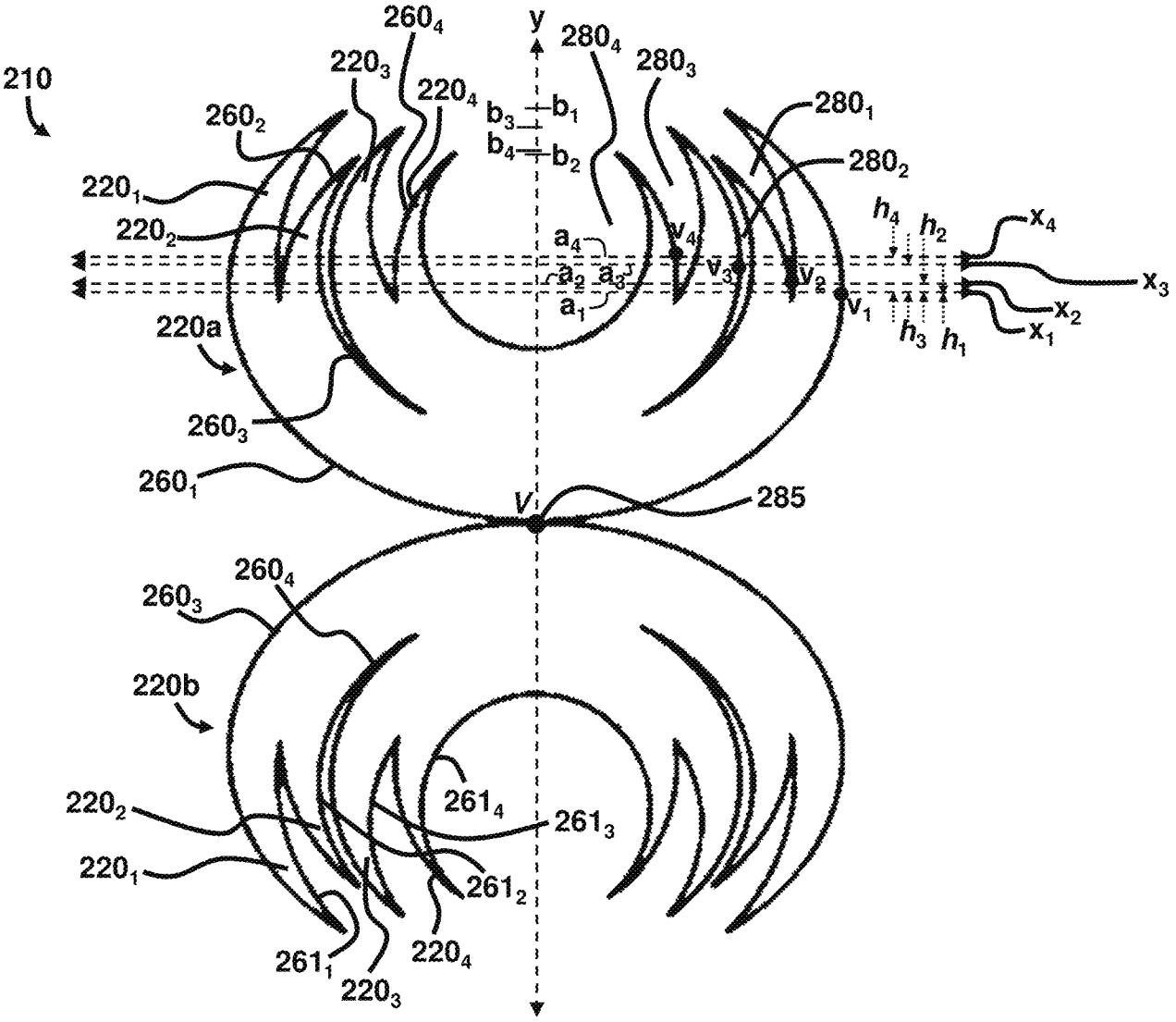
FIG. 11 is a schematic diagram illustrating a dipole antenna depicting the various axes of the crescent-shaped arms, according to an embodiment herein.

With respect to FIG. 11, with reference to FIGS. 1 through 10, the following equations describe some example ellipses that can be used to derive the four elliptical or crescent-shaped arms $\mathbf{220}_1 \ldots \mathbf{220}_4$ for the dipole antenna 210:

Crescent arm $\mathbf{220}_1$:

Base ellipse: $(x_1^2/a_1^2)+(y_1^2/b_1^2)=1$, where a and b are the semi-major and semi-minor axes.

Gap $\mathbf{280}_1$: $(x_1-1.9)^2/a_1^2+(y_1^2/b_1^2)=1$

Crescent arm 2202:

Base ellipse: $(x_2^2/a_2^2)+(y_2^2/b_2^2)=1$, where a and b are the semi-major and semi-minor axes.

Gap $\mathbf{280}_2$: $(x_2-3.4)^2/a_2^2+(y_2^2/b_2^2)=1$

Crescent arm 2203:

Base ellipse: $(x_3^2/a_3^2)+(y_3^2/b_3^2)=1$, where a and b are the semi-major and semi-minor axes.

Gap $\mathbf{280}_3$: $(x_3-3.4)^2/a_3^2+(y_3^2/b_3^2)=1$

Crescent arm $\mathbf{220}_4$:

Base ellipse: $(x_4^2/a_4^2)+(y_4^2/b_4^2)=1$, where a and b are the semi-major and semi-minor axes.

Gap $\mathbf{280}_4$: $(x_4-3.3)^2/a_4^2+(y_4^2/b_4^2)=1$

The overall shapes of the arms $\mathbf{220}_1 \ldots \mathbf{220}_4$ are established by positioning the inflection points (e.g., vertices $v_1 \ldots v_4$) of the convex edge $\mathbf{260}_1$-$\mathbf{260}_4$ of each arm $\mathbf{220}_1 \ldots \mathbf{220}_4$, respectively, a specified distance $h_1 \ldots h_4$ directly above the corresponding point on the largest crescent arm (e.g., arm $\mathbf{220}_1$). This is done such that the concave sides $\mathbf{261}_1 \ldots \mathbf{261}_4$ of the crescent arms $\mathbf{220}_1 \ldots \mathbf{220}_4$, respectively, are oriented in the same direction. For example, the specific offset distances $h_1 \ldots h_4$ for the respective crescent-shaped arms $\mathbf{220}_1 \ldots \mathbf{220}_4$ may be as follows (in cm): $h_1=0$, $h_2=1$, $h_3=6.2$, $h_4=7$, in one example embodiment.

In an example, the embodiments herein reduce the surface area of a conventional VHF/UHF elliptical dipole by 40% without loss of impedance bandwidth or a significant degradation of radiation pattern while simultaneously maintaining compatibility with composites manufacturing techniques. In an example, to achieve this 40% reduction in surface area, the overall foot print of the completed antenna 210 may have a height=64.5 cm and a width=48 cm. According to an example, the height dimension includes a 2 mm gap $\mathbf{280}_1 \ldots \mathbf{280}_3$ between the arms $\mathbf{220}_1 \ldots \mathbf{220}_4$ at the feed point 285, which is located at the inflection point (e.g., vertex V) of the convex edge $\mathbf{260}_1$ on the largest crescent arm $\mathbf{220}_1$ of each dipole arm 220*a*, 220*b*.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Those skilled in the art will recognize that the embodiments herein can be practiced with modification within the spirit and scope of the appended claims.

What is claimed is:

1. An antenna comprising:

a crescent-shaped antenna body comprising a plurality of crescent-shaped arms having crescent-shaped notched ends; and a connector positioned on a substantially non-jagged portion of the crescent-shaped antenna body to receive input energy, wherein the antenna body operates in a continuous frequency band of operation.

2. The antenna of claim 1, wherein the antenna body transmits an omni-directional output beam.

3. The antenna of claim 1, wherein the antenna body is structurally conformable.

4. The antenna of claim 1, wherein the antenna body is configured to attach to flexible surfaces.

5. The antenna of claim 1, wherein the antenna body is configured to attach to non-planar surfaces.

6. The antenna of claim 1, wherein the continuous frequency band of operation comprises approximately 165 MHz to 1.35 GHz.

7. The antenna of claim 1, wherein the antenna body is configured to have an average voltage standing wave ratio of approximately 1.72:1 across the continuous frequency band of operation.

8. The antenna of claim 1, wherein the antenna body is comprised of a foam substrate and is configured to have an average voltage standing wave ratio of approximately 1.85:1 across the continuous frequency band of operation.

9. The antenna of claim 1, wherein the antenna body comprises a dipole configuration.

* * * * *